US005983890A

United States Patent [19]

Thomas et al.

[11] Patent Number: 5,983,890

[45] Date of Patent: Nov. 16, 1999

[54] FIREPLACE HAVING MULTI-ZONE HEATING CONTROL

[75] Inventors: Martin Thomas, Toronto; Sydney Richard Barkhouse, Mississauga; John Charles Kenzie Overall, Scarborough; Dick D. Gepilano, Mississauga; James Karl Georgieff, Scarborough; Heinz H. Rieger, Toronto, all of Canada

[73] Assignee: Canadian Gas Research Institute, Richmond Hill, Canada

[21] Appl. No.: 09/005,265

[22] Filed: Jan. 9, 1998

[51] Int. Cl.[6] ..... F23C 1/18; F24C 3/00; F24B 1/189

[52] U.S. Cl. ..... 126/512; 126/523; 126/509; 126/508; 126/521; 126/533; 126/92 R; 165/48.1; 165/901

[58] Field of Search ..... 126/512, 523, 126/524, 533, 509, 521, 522, 531, 92 R, 92 AC, 93, 94, 86, 89, 508, 503; 431/125; 165/48.1, 901, 58; 236/1 B, 10, 11

[56] References Cited

U.S. PATENT DOCUMENTS

| | | | |
|---|---|---|---|
| 2,359,197 | 9/1944 | Brooks | 126/508 |
| 2,484,292 | 10/1949 | Hermanson | 126/121 |
| 2,789,554 | 4/1957 | Dupler | 126/524 |
| 3,452,737 | 7/1969 | Pellegrino et al. | 126/121 |
| 3,742,929 | 7/1973 | Dupler | 126/133 |
| 3,995,611 | 12/1976 | Nelson | 126/121 |
| 4,055,297 | 10/1977 | Lee | 236/11 |
| 4,102,320 | 7/1978 | Mastropole | 126/121 |
| 4,126,118 | 11/1978 | Haynes | 126/512 |
| 4,132,263 | 1/1979 | Stinnett | 165/901 |
| 4,163,442 | 8/1979 | Welty | 126/522 |
| 4,170,219 | 10/1979 | Hansen et al. | 126/121 |
| 4,174,701 | 11/1979 | Gneiting | 126/121 |

(List continued on next page.)

OTHER PUBLICATIONS

"Electro–Thermal Actuators", Thermotion Corporation, CGRI Project #95G119, Milestone Report.

"Fireplace Model BIS II Installation and Operation Manual", SecurityChimneys Ltd.

"Standard for Factory–Built Fireplaces", National Standard of Canada, Underwriters' Laboratories of Canada, CAN/ULC–S610–M87.

"Owner's Manual for Models HT & C, Residential Factory Built Fireplace, Opel 2000", RSF Energy.

"Instruction Manual, Regency Fireplace Products, The Regency Warm Hearth High Effeciency EPA Certified Fireplace", Regency Industries Ltd.

*Primary Examiner*—Ira S. Lazarus
*Assistant Examiner*—Josiah C. Cocks
*Attorney, Agent, or Firm*—Baker & Daniels

[57] ABSTRACT

A fireplace adapted to heat multiple heating zones of a building, controlled by a control circuit which adjusts the heat input to the fireplace, airflow through the fireplace and ducting of the airflow to the various zones individually in response to a call for heat by thermostats in the zones. The fireplace may also be adapted to provide cooled or circulated air to the zones and may also serve to provide heating to the zones in the event of an electrical power outage. The fireplace is provided with a cabinet having ducts through which air is conveyed by use of a fan to a tube-type heat exchanger, the heat exchanger also in communication with the hot flue gases exiting the combustion chamber of the fireplace. The air heated by the heat exchanger is conveyed to a multitude of fireplace outlets, each of which is provided with a damper which regulates the airflow through the outlet to one of the zones to be heated, depending on whether that zone calls for heat through its thermostat. The fireplace is also provided with an evaporator core in an evaporator case, the core being part of an air conditioning system. Air flowing through the fireplace may bypass the cabinet ducts and tube-type heat exchanger, instead being directed to flow through the evaporator core, where it may be cooled, and then to the fireplace outlets for distribution to the zones.

36 Claims, 13 Drawing Sheets

U.S. PATENT DOCUMENTS

| | | | |
|---|---|---|---|
| 4,179,065 | 12/1979 | Zung | 126/521 |
| 4,185,611 | 1/1980 | Johnson | 126/121 |
| 4,206,744 | 6/1980 | Mahoney et al. | 126/121 |
| 4,231,516 | 11/1980 | Weingartner | 165/901 |
| 4,258,880 | 3/1981 | Willamson | 126/509 |
| 4,291,670 | 9/1981 | Hyatt | 126/121 |
| 4,332,236 | 6/1982 | Stora et al. | 126/121 |
| 4,470,400 | 9/1984 | Fleisler | 126/522 |
| 4,649,808 | 3/1987 | Ward et al. | 98/59 |
| 4,773,589 | 9/1988 | Boyd | 237/51 |
| 4,793,322 | 12/1988 | Shimek et al. | 126/80 |
| 4,821,473 | 4/1989 | Cowell | 52/218 |
| 4,836,182 | 6/1989 | Trowbridge | 126/109 |
| 4,909,227 | 3/1990 | Rieger | 126/531 |
| 5,062,411 | 11/1991 | Karabin et al. | 126/523 |
| 5,076,254 | 12/1991 | Shimek et al. | 126/512 |
| 5,092,313 | 3/1992 | Blackburn et al. | 126/512 |
| 5,218,953 | 6/1993 | Shimek et al. | 126/512 |
| 5,267,552 | 12/1993 | Squires et al. | 126/512 |
| 5,499,622 | 3/1996 | Woods | 126/521 |
| 5,555,876 | 9/1996 | Francisco, Jr. et al. | 126/504 |
| 5,571,008 | 11/1996 | Richardson et al. | 126/512 |
| 5,575,274 | 11/1996 | DePalma | 126/512 |
| 5,590,642 | 1/1997 | Borgeson et al. | 126/116 A |
| 5,775,408 | 7/1998 | Shimek et al. | 126/512 |

FIREPLACE HAVING MULTI-ZONE HEATING CONTROL

BACKGROUND OF THE INVENTION

This invention relates to a gas fireplace, and, in particular, to a gas fireplace adapted to provide heat to multiple zones of a building.

Known in the art are a multitude of different types of gas fireplaces, including gas fireplaces such as freestanding models and zero clearance models which provide heating to the room in which it is located. These fireplaces commonly include housings or shells that surround the combustion chambers or fireboxes where combustion of a gaseous fuel, such as propane or natural gas, occurs. The walls of the housing are typically constructed in spaced relationship with some or all of the walls of the combustion chamber, including the bottom wall and top wall which form the floor and ceiling of the combustion chamber. The resulting space or plenum provided between the combustion chamber and housing permits the formation of passageways suitable to circulate air. Existing fireplaces have used these passageways to circulate air to serve a number of nonexclusive purposes, including the transfer of heat to room air which is inlet into these passageways and circulated therethrough by means of natural convection or electric motor driven fans. The inlet room air is discharged from the fireplace at a higher temperature to heat only the room in which the fireplace unit is installed, with any heating provided by the fireplace to other rooms being incidental. Thus, buildings having previously known fireplaces are generally provided with a separate furnace or other heating means and, in some cases, an air conditioner for cooling or circulating air throughout the building incorporated into the separate furnace or standing alone.

Generally, present direct vent fireplaces have steady state efficiencies of up to approximately 75 percent, and Annual Fuel Utilization Efficiencies (AFUE) in the 60 to 65 percent range. Improvements in these efficiencies would, of course, be desirable, although it is recognized in the art that the steady state efficiency is limited to a maximum of 83 percent to prevent condensation in the flue in noncondensing applications. Generally, flue gas temperatures at the flue terminal should be about 190° F. (87.8° C.), or at least 50° F. (27° C.) above the dew point of the flue gases.

It is also desirable to provide a fireplace which serves an aesthetic function as well as providing heat to rooms or zones other than the zone in which the fireplace is installed in response to calls for heat from the remote zones, obviating the need for a separate furnace. With the fireplace taking the place of a furnace, it is desirable to also have the ability to provide the heated air and unheated or cooled air to the various zones through common air conveyance means. Moreover, in the event of electrical power failure, it is desirable that some quantity of heat still be provided to the various zones.

SUMMARY OF THE INVENTION

The present invention provides, in one form thereof, a gas-fired, zero clearance fireplace comprising an internal plenum and a heat exchanger through which interior air is circulated by means of an electric motor driven fan. The heat transferred to the circulated interior air is provided by the products of combustion or flue gases which flow through the heat exchanger and, to a significant degree, by heat conducted through the walls separating the combustion chamber and the internal plenum of the fireplace cabinet. The heated interior air is distributed to the various zones individually via a plurality of distribution ducts, based on the call for heat in each zone. Thus the present invention provides a fireplace which may serve as a furnace for convectively heating the various zones of a building, including the zone in which the fireplace is located (zone 1), as well as providing an aesthetic function and radiant heating of the room in which the fireplace is located. Owing to the rather large total heat transfer surface area between the combustion chamber and the housing or cabinet plenum and across the heat exchanger, the steady state efficiency of the inventive fireplace has been measured at approximately 83 percent, and the AFUE calculated to approximately 78 to 80 percent. Thus, the inventive fireplace improves on the efficiencies demonstrated by many previous gas fireplaces of the noncondensing type.

The distribution ducts are each provided with a damper which controls the airflow therethrough in response to the call for heat in the associated zone. Additionally, the fan speed is variable, depending on the number of zones calling for heat. Further, the amount of energy input to the combustion chamber is variable by means of a modulating fuel valve. A control circuit controls damper position, fan speed and the amount of fuel flow to the combustion chamber. Inputs to the control circuit include thermostats in each zone, a collector space temperature (upstream of the distribution ducts), an emergency heating override switch and a manual fireplace potentiometer.

In another form thereof, the present invention provides a gas-fired, zero clearance fireplace as described above and also comprising an air conditioning unit through which forced air may be ducted, bypassing the heat exchanger and thus providing a fireplace which serves not only as a furnace, but as a unit for cooling or merely circulating unheated interior air to be distributed to the various zones via the distribution ducts.

The present invention provides a fireplace including a cabinet, a combustion chamber within the cabinet, a burner and decorative logs disposed in the combustion chamber, the cabinet having a transparent panel through which the logs are viewed. The cabinet further has first and second plenums fluidly connected to an interior air inlet and outlet means, respectively. The plenums are in series connection with a heat exchanger, the heat exchanger in thermal connection with the combustion chamber. The interior air outlet means of the fireplace is in connection with a plurality of distribution ducts leading to a plurality of individual zones.

The present invention also provides a fireplace including a cabinet, a combustion chamber within the cabinet, a burner and decorative logs disposed in the combustion chamber, the cabinet having a transparent panel through which said decorative logs are viewed, a first plenum fluidly connected to an interior air inlet and a second plenum fluidly connected to interior air outlet means. A heat exchanger in thermal communication with hot gases generated in the combustion chamber is connected in series with the first and second plenums, together defining a generally W-shaped interior air flow path through the cabinet.

The present invention also provides a fireplace including a cabinet, a combustion chamber within the cabinet, a burner and decorative logs disposed in the combustion chamber, the cabinet having a transparent panel through which the decorative logs are viewed, a first plenum in fluid communication with an interior air inlet and a second plenum. The first and second plenums are in series connection with a heat exchanger which is in thermal connection with hot gases generated in said combustion chamber. A bypass plenum adjacent the cabinet has a diverter mechanism disposed therein, the diverter mechanism selectively connecting the interior air inlet with either an evaporator core or the first cabinet plenum. The evaporator core is in fluid communication with the bypass plenum and fireplace outlet means.

The present invention also provides a system for heating a plurality of zones in a building. The system includes a fireplace including a cabinet, a combustion chamber located in the cabinet, and a burner and decorative logs disposed in the combustion chamber. The cabinet also has a transparent panel through which the logs are viewed, a first plenum in fluid communication with an interior air inlet, a second plenum in fluid communication with a plurality of interior air outlets, and a heat exchanger in series connection with the first and second plenums. The heat exchanger is in thermal communication with hot gases generated in the combustion chamber. The system also includes a system of distribution ducts in fluid communication with the interior air outlets and a plurality of individual zones, each outlet connected to a respective, individual zone by a respective distribution duct. Thus, interior air exiting the fireplace through at one of the interior air outlets is conveyed to a corresponding zone.

The present invention further provides a fireplace having a cabinet, a combustion chamber within the cabinet, and decorative logs and a burner disposed in the combustion chamber. The cabinet also includes a transparent panel through which said logs are viewed and first and second plenums. A heat exchanger is in thermal communication with the combustion chamber and is interposed between the first and second plenums. The heat exchanger has walls defining a generally U-shaped interior air flow path, and a plurality of conduits extending through the interior air flow path and through which conduits combustion gases flow.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 1B:
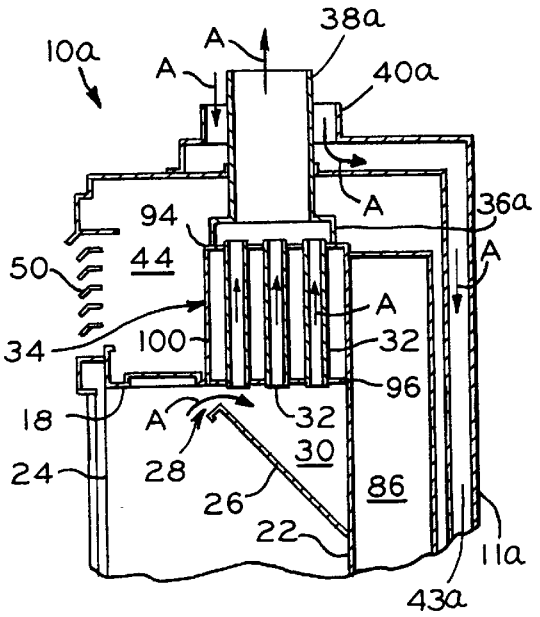
FIG. 1B is a fragmentary side view of an alternative embodiment to that shown in FIG. 1A, the cold combustion air and hot flue gases entering and exiting the fireplace through the top thereof.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention in alternative forms, and such exemplifications are not to be construed as limiting the scope of the invention in any manner.

DETAILED DESCRIPTION OF THE INVENTION

The embodiments disclosed below are not intended to be exhaustive or limit the invention to the precise forms disclosed in the following detailed description. Rather, the embodiments are chosen and described so that others skilled in the art may utilize its teachings.

Figure 1A:
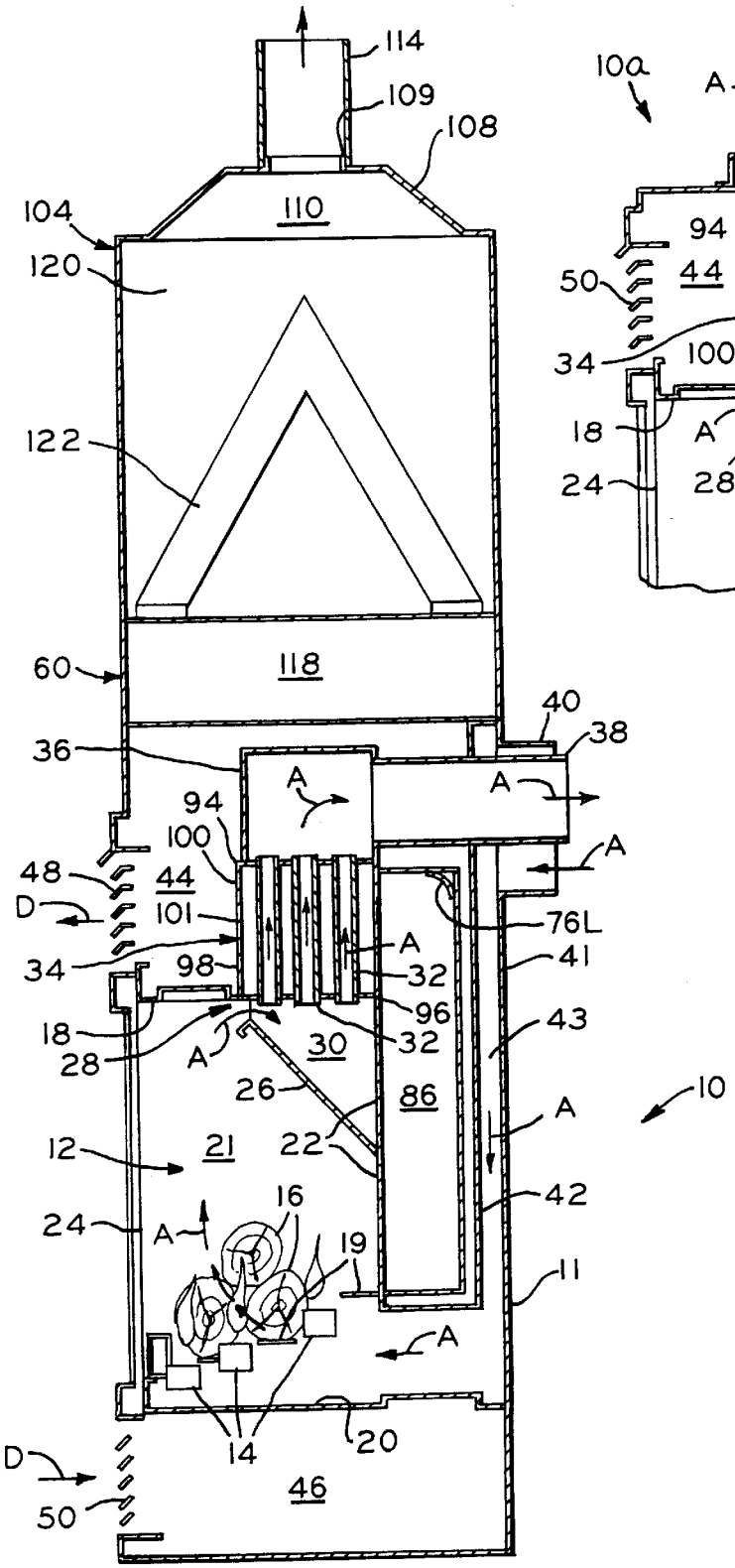
FIG. 1A is a sectional side view of a fireplace according to the present invention.
Figure 6:
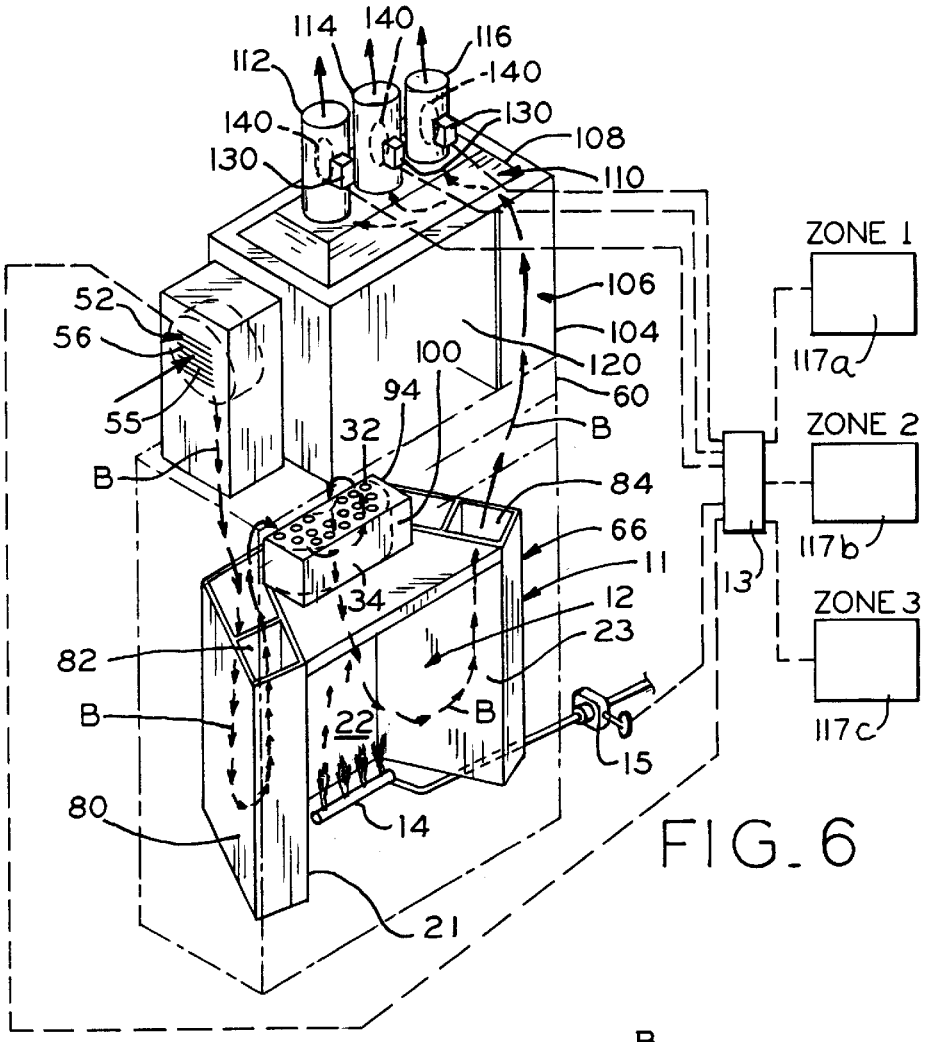
FIG. 6 is a schematic perspective view of the fireplace of FIG. 1A, showing airflow therethrough in furnace mode, the gas valve, fan assembly and damper actuators of the fireplace shown in communication with schematically-represented thermostats and a control circuit via dashed lines.
Figure 7:
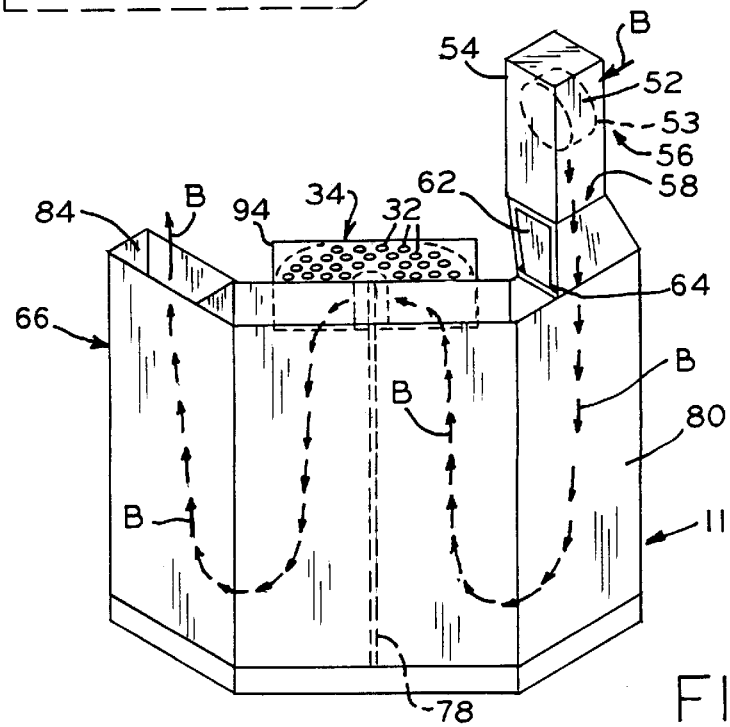
FIG. 7 is a schematic upper rear perspective view of cabinet plenums of the fireplace of FIG. 6, showing airflow therethrough.

Referring to the drawings and particularly to FIG. 1A, there is shown fireplace 10, a first embodiment of a fireplace according to the present invention, comprising housing or cabinet assembly 11 within which is located combustion chamber 12. In the lower portion of combustion chamber 12 is at least one burner element 14, comprising apertures through which a gaseous fuel, such as propane or natural gas, is provided for burning. Burner element 14 is supplied through electrically modulated valve 15 (FIG. 6). One relay acts as an on/off control to one set of electrical contacts in gas valve 15, and a 70–120 mA, 24 VDC to 120 Ohm modulating signal controls valve modulation between low, medium, and high flow levels through a second set of electrical contacts. Valve actuation, for either on/off or flow level variation, is controlled by the control circuit 13. A small amount of flow through a bypass in valve 15, allowing flow around a main flow valve in valve 15, is provided in the "pilot" position to support the pilot light. As known in the art, a Piezoelectric ignitor is provided for igniting the pilot flame. A thermocouple proximate to the pilot light and ignitor generates sufficient voltage to modulating valve 15 to sustain the pilot, the pilot itself generating sufficient heat to generate sufficient voltage through the thermocouple to provide pilot sustaining flow through the bypass in valve 15. A thermopile located proximate to the pilot light generates, due to the heat of the pilot, sufficient voltage to valve 15 to keep its main flow valve open. Once lit, the pilot remains on unless manually turned off. In the event of an electrical power outage, the on/off contacts open automatically through the control circuit or, alternatively, manually, and flow is maintained through valve 15 if the pilot light is on. If the pilot light is not on, manual ignition of the pilot is required. Alternative to the standing pilot configuration, electronic ignition of the pilot may employed. As will be discussed below, emergency heating mode will permit sustaining a low heat input level flow through the valve. Above burner element 14 are normally a plurality of ceramic logs 16 of conventional type about which the flames extend, enhancing the aesthetic properties of the fireplace.

As seen in FIG. 1A, combustion chamber 12 is generally defined by top wall 18, bottom wall 20 adjacent which air for combustion flows toward burner element 14 through apertures in panel 19, side walls 21, 23, rear wall 22 and transparent front panel 24 through which logs 16 and the flames may be observed. Temperatures in the combustion chamber may range from approximately 700–1000° F. (371–538° C.), depending on the heat input, and therefore panel 24 may be made of ceramic glass or other high temperature glass which can withstand temperatures up to approximately 740° C. Referring to FIG. 6, portions of side walls 21, 23 of combustion chamber 12 are angled inwardly toward each other from front to rear. In combustion chamber 12, extending between walls 21, 23 at an upward angle from rear wall 22, is deflector plate 26, best seen in FIG. 1A. Combustion chamber 12 is sealed from the interior room space in which fireplace 10 is installed, and is open to fluid communication with spaces outside the fireplace only through the combustion air inlet and flue gas exhaust pipes, as described below. An alternative embodiment of the inventive fireplace may have openable glass doors (not shown) in lieu of transparent panel 24, in which case chamber 12 would not be as well sealed as fireplace 10. With the exception of transparent front panel 24, and as is typical in the art, fireplace 10 is generally fabricated from 18 to 20 gauge sheet steel plated with a corrosion resistant plating which may be zinc or another material used in applications of this nature. Also as is typical of the art, the fireplace surfaces visible after installation are normally painted with a high temperature paint, and the visible steel surfaces inside combustion chamber 12 may also be covered with a suitable cosmetic refractory material, which may have some nominal heat reflective properties and be patterned to simulate the appearance of firebricks.

Elongate lateral opening 28, through which the hot, gaseous products of combustion flow, is provided between the forward portion of deflector plate 26 and top wall 18 between side walls 21, 23. These flue gases, as they are known, enter space 30 from opening 28, and from space 30 flow upwardly through a plurality of tubes 32 of heat exchanger 34, which is adjacent top wall 18 and sealed thereto about the perimeter of a large opening therein. Thus, the bottom of heat exchanger 34 defines a portion of top combustion chamber wall 18. Heat from the flue gases is conducted through the sheet metal walls of combustion chamber 12 and cylindrical heat exchanger tubes 32 to warm interior air flowing through the cabinet plenum and heat exchanger, as will be further discussed below.

Flue gases exiting from the tops of heat exchanger tubes 32 enter the interior of plenum 36, which is sealed to the top of heat exchanger 34. The flue gases exit plenum 36 through horizontal flue gas pipe 38, which extends through an exterior wall of the building. Also extending through the exterior wall of the building and surrounding flue gas pipe 38 is combustion air intake pipe 40, the interior end of which is sealed to an opening in rear wall 41 of fireplace cabinet 11. Vertical plenum wall 42 has an opening through which flue gas pipe 38 sealably extends, is spaced from rear cabinet wall 41 towards the interior of the building and, with horizontal top and vertical side walls (not shown) extending from wall 42 to wall 41, define combustion air intake plenum 43, which conveys fresh air to combustion chamber 12 to support combustion therein. Arrows A (FIG. 1A) define the general path of combustion air and flue gases through fireplace 10. FIG. 1B depicts an intake/exhaust structure which may be used in an alternative embodiment of a fireplace according to the present invention. Here, combustion air and flue gases enter and exit fireplace 10*a* through the top thereof along the path generally indicated by arrows A.

Space 44 and space 46 may be provided above and below combustion chamber 12, respectively, and are in fluid communication via incidental air passageways formed in constructing cabinet 11 to the sides and rear of combustion chamber 12. Grills 48, 50 may be provided in the front of spaces 44, 46 above and below glass panel 24 and allow interior air to flow into lower grille 50 and out of upper grille 48, as indicated by arrows D, by natural convection due to the heat generated in combustion chamber 12. Particularly in emergency heating mode, when no air is being forced by the fan through the interior cabinet plenum and heat exchanger 34 due to an electrical power failure, the naturally convective airflow occurring through spaces 44, 46 and the incidental passageways therebetween is useful to provide a small quantity of heat transfer from combustion chamber top 18, the outside wall surfaces of heat exchanger 34 and plenum 36 to zone 1, in which fireplace 10 is located, thus helping to prevent overheating of the fireplace.

Figure 2A:
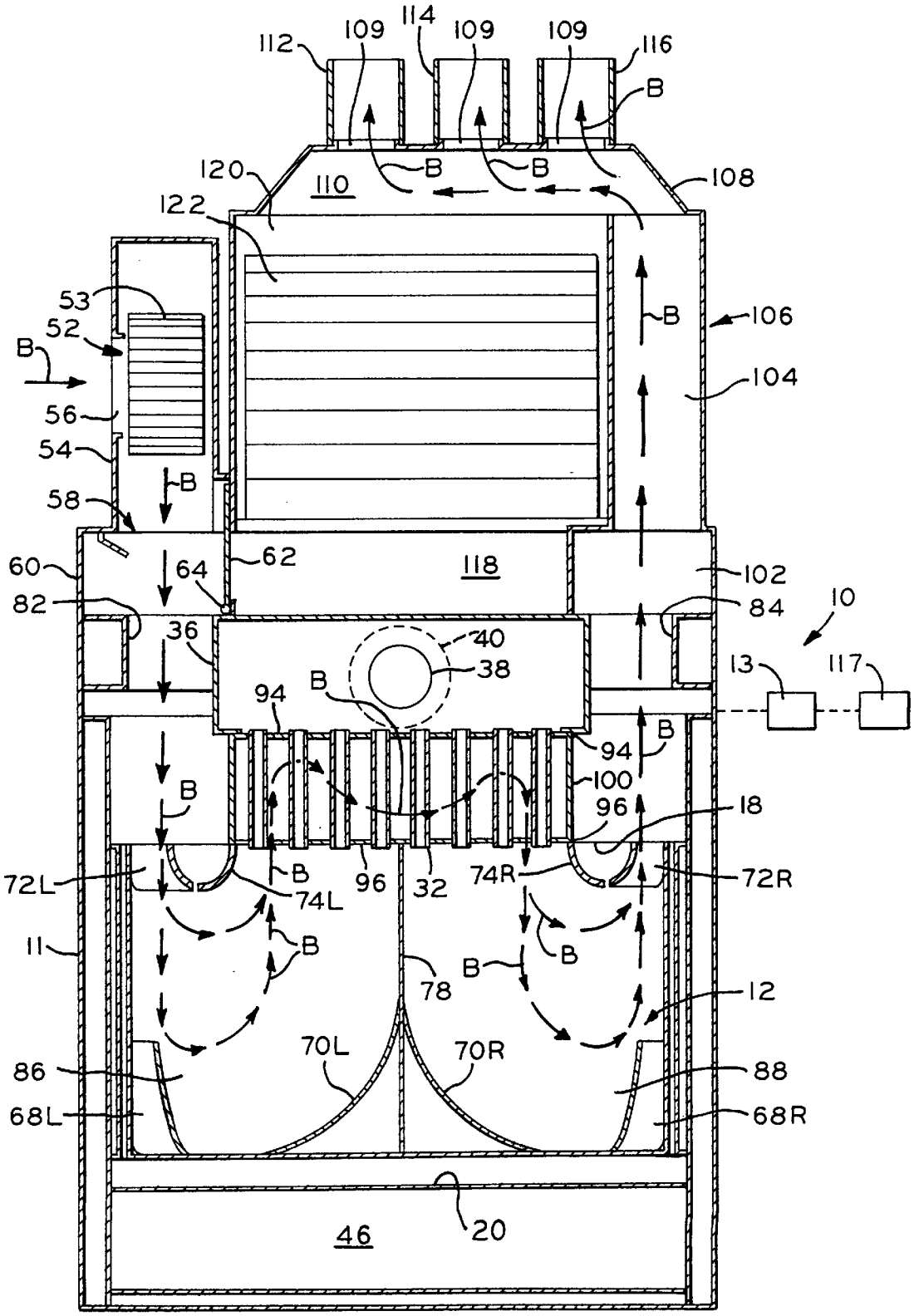
FIG. 2A is a front partial sectional view of the fireplace of FIG. 1A, showing airflow therethrough in a furnace mode, the fireplace shown in communication with a schematically-represented thermostat and control circuit via dashed lines.

Fan assembly 52 is provided in fan housing 54, located above fireplace cabinet 11, and comprises centrifugal fan 53 and a driving electric fan motor (not shown). In fireplace 10, the control circuit 13 triggers three relays, allowing three fan motor speed settings. The fan motor may have either three windings or a single winding controlled with two AC speed controllers. Building interior air may be provided to fan housing inlet 56 from air exchanger inlet 55 servicing only the room in which fireplace 10 is installed (FIG. 6), or from common air exchange ductwork (not shown) servicing multiple heating and cooling zones in the building. Alternatively, in lieu of single fan assembly 52, a plurality of smaller fans and motors may be provided in an appropriately adapted fan housing or in individual distribution ducts leading to each zone, with attendant revisions to the control circuit 13. Fan housing outlet 58 provides airflow to the inlet of air collector box 60 upstream of heating/cooling diverter door 62 provided therein. Diverter door 62 pivots about hinge 64 to direct the airflow received from fan housing outlet 58 either into a plenum provided in fireplace housing or cabinet 11 for heating, or through air conditioning evaporator housing 120 for cooling or unheated air circulation. Diverter door 62 is actuated by an electric solenoid, motor or electro-thermal actuator (not shown) which, when energized, directs the air received from fan housing outlet 58 along a path generally indicated by arrows C (FIG. 2B) by which it may be cooled. When its actuator is not energized, diverter door 62 assumes a position which directs the air through the plenum inside cabinet 11, where it will be heated (FIG. 2A). By adapting door 62 to be so positioned in the absence of a voltage to its actuator, the building interior air can be still be heated to some extent in the event of an electrical power outage, as further described below.

Figure 2B:
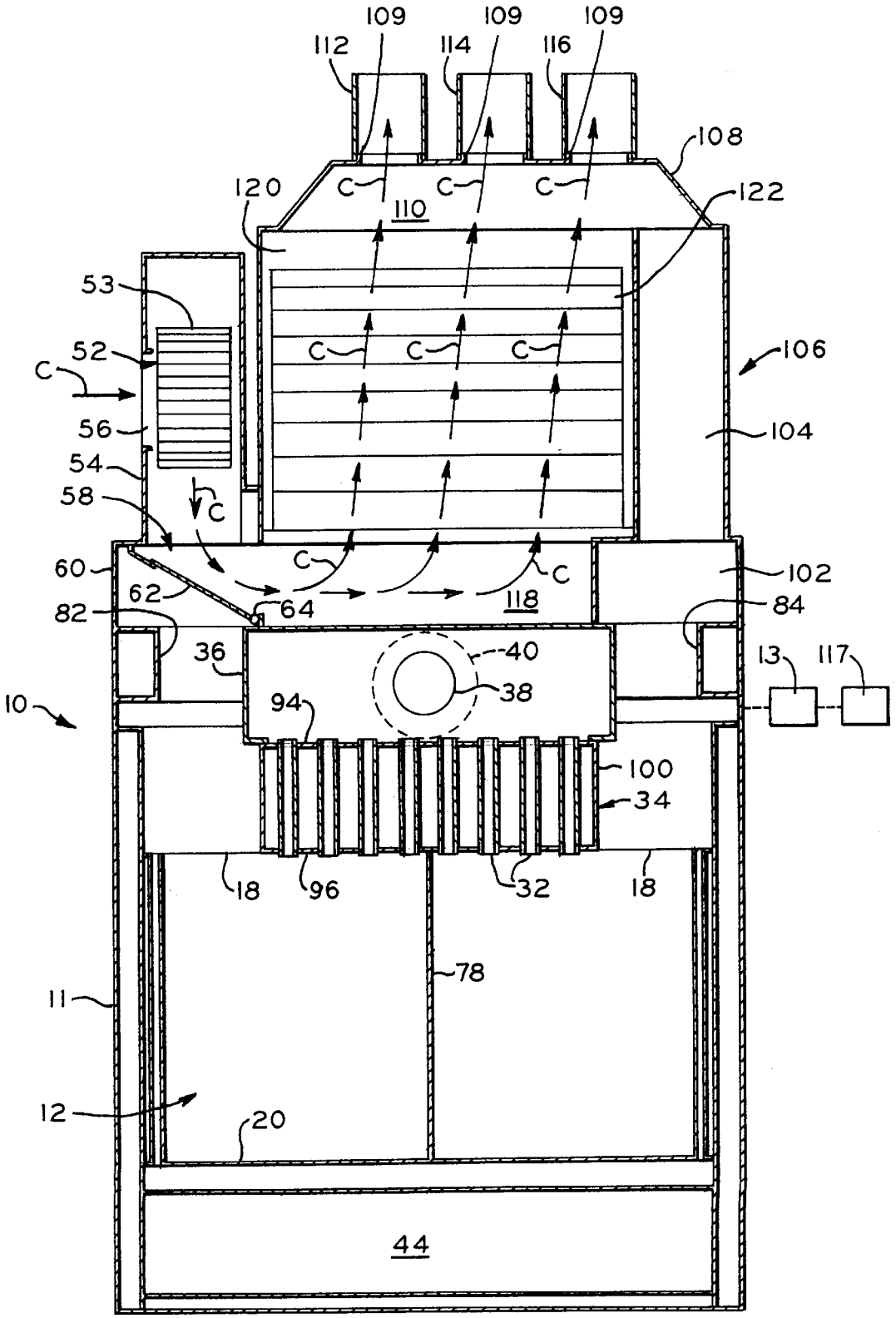
FIG. 2B is a front partial sectional view of the fireplace of FIG. 2A, showing airflow therethrough in an air conditioning mode, the fireplace shown in communication with a schematically-represented thermostat and control circuit via dashed lines.

FIG. 2A shows diverter door 62 in its heating position, with airflow following the general path indicated by arrows B downward through air collector box 60 and inlet 82 of the plenum of cabinet 11, through the cabinet plenum to and from heat exchanger 34, and then out of the cabinet plenum through outlet 84 and distributed to the zone(s) to be heated. FIG. 2B shows diverter door 62 in its cooling/circulation position, with airflow following the general path indicated by arrows C transversely through air collector box 60, then upwards into evaporator housing 120, where it may be cooled, and then to the various zones, bypassing fireplace cabinet 11 altogether.

Figure 4:
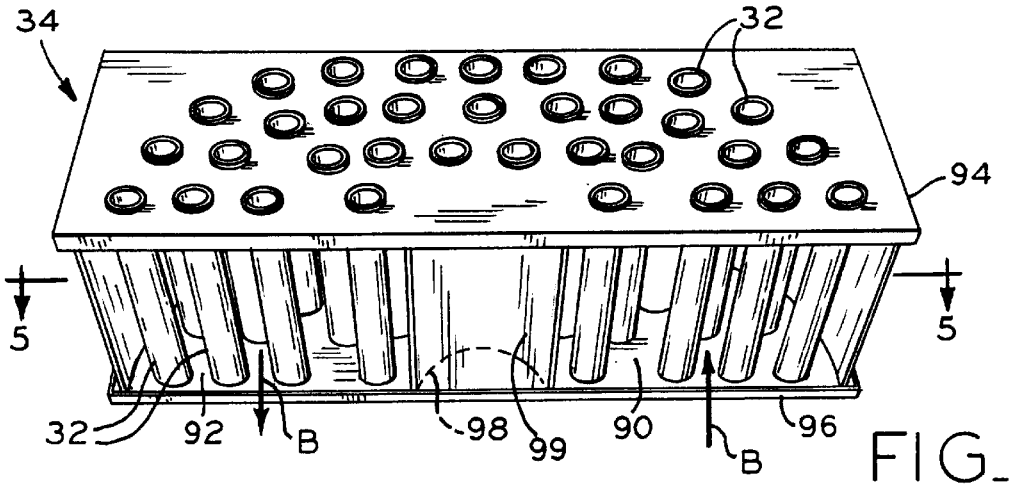
FIG. 4 is a rear perspective view of the tubular heat exchanger of FIG. 3.
Figure 8:
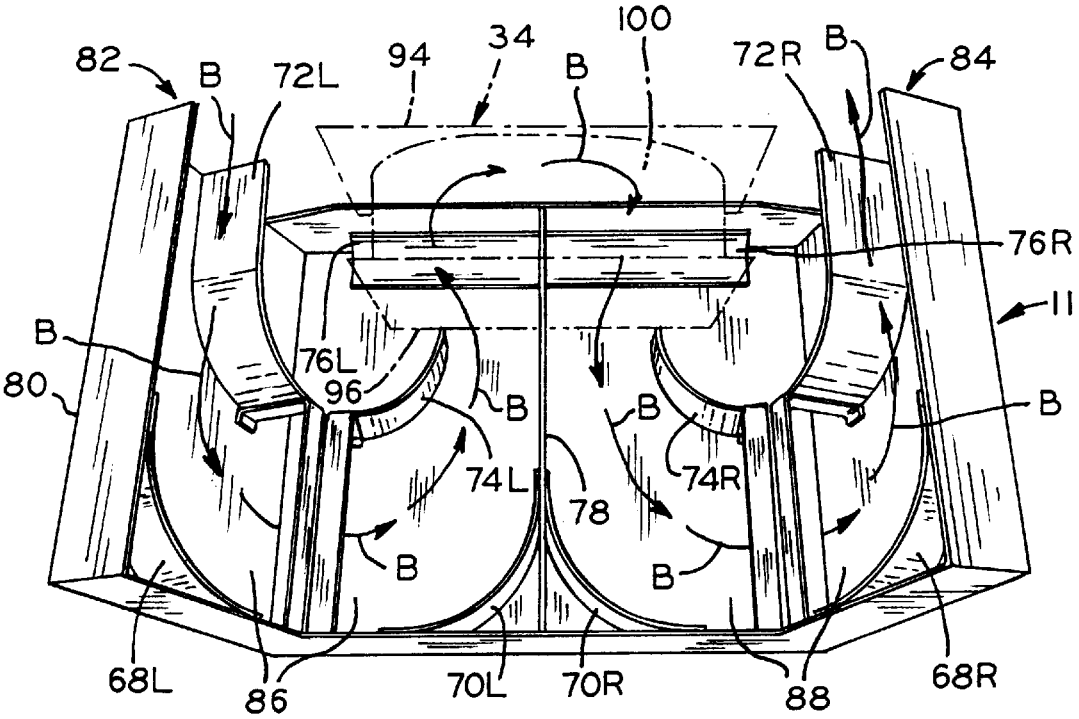
FIG. 8 is a lower front perspective view of the cabinet plenum of the fireplace of FIG. 6, showing airflow therethrough.

Referring to FIGS. 2A and 6–8, it can be seen that airflow directed along the path generally indicated by arrows B through the plenum of housing or cabinet 11 is controlled by baffles provided in airflow wrapper 80, a single formed sheet of steel which comprises the outermost walls of the cabinet plenum. As best seen in FIG. 8, which shows the plenum of cabinet 11 with combustion chamber bottom wall 20, panel 19, side walls 21, 23 and rear wall 22 removed and heat exchanger 34 indicated by ghosted lines, airflow indicated by arrows B is directed through the cabinet plenum by curved baffles which mirror each other on the right and left hand sides of fireplace 10, the right and left hand sides defined from the perspective of a person facing the fireplace from inside the room in which it is installed. In the drawings, a reference numeral ending in "L" designates a left hand element, and a common reference numeral ending in "R" designates the corresponding right hand element, which may be identical to its left hand counterpart. Lower outer left hand baffle 68L and upper outer left hand baffle 72L are attached to wrapper 80 and abut side wall 21 of combustion chamber 12. Similarly, on the right hand side of fireplace 10, corresponding right hand baffles 68R, 72R abut side wall 23. Lower inner left and right hand baffles 70L, 70R and upper inner left and right hand baffles 74L, 74R are attached to wrapper 80 on opposite sides of vertical central dividing partition 78, which has a height equivalent to the arcuate baffles. Rear combustion chamber wall 22 abuts baffles 70L, 70R, 74L, 74R and central partition 78. Thus, baffles 68L, 70L, 72L and 74L, the wall of wrapper 80 between these baffles, side wall 21 and half of rear wall 22 define generally U-shaped left hand plenum 86. Similarly, baffles 68R, 70R, 72R and 74R, the wall of wrapper 80 between these baffles, side wall 23 and the other half of rear wall 22 define generally U-shaped right hand plenum 88. Adjacent the topmost ends of baffles 74L, 74R, and abutting the forward edge of divider 78, heat exchanger 34 is disposed, centered laterally over the large hole in combustion chamber top wall 18 and sealed thereto. Referring to FIGS. 4 and 8, airflow from left hand plenum 86 is directed into left hand inlet 90 at the rear of heat exchanger 34, and air received from right hand outlet 92 at the rear of heat exchanger 34 is directed into right hand plenum 88. Central upper left and right hand baffles 76L, 76R, attached to the surfaces defining the upper rear inside corner of wrapper 80 help smooth the airflow from left hand plenum 86 to inlet 90, and from outlet 92 to right hand plenum 88. From the foregoing it may thus be understood that the plenum of cabinet 11 may be described as providing a generally W-shaped flow path, especially when viewed from the front of fireplace 10, with generally U-shaped plenums 86, 88 arranged in series, heat exchanger 34 being intermediate the end of plenum 86 and the beginning of plenum 88.

Figure 3:
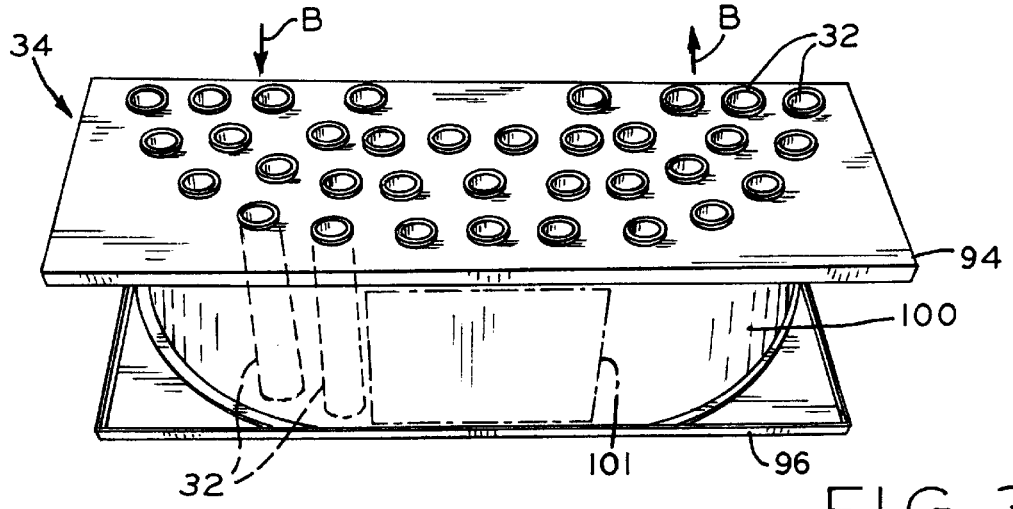
FIG. 3 is a front perspective view of the tubular heat exchanger of the present invention.
Figure 5:
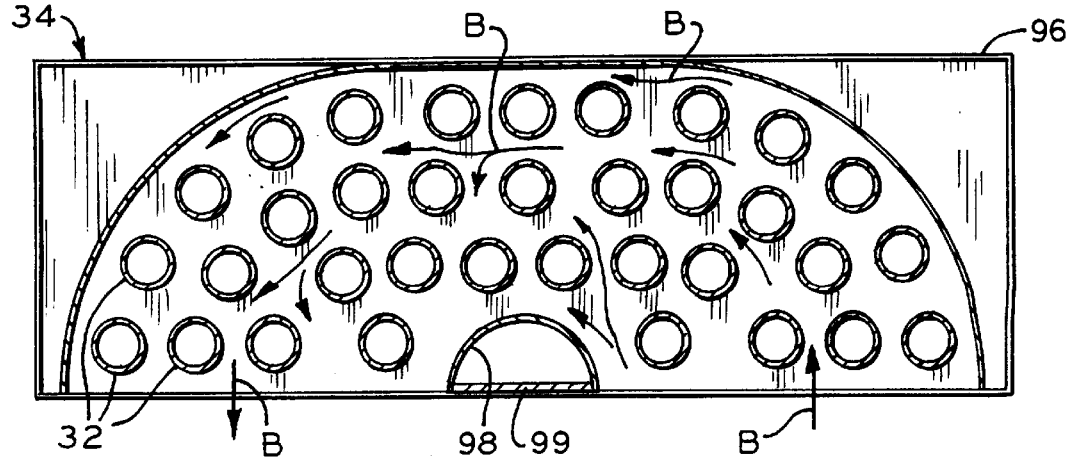
FIG. 5 is a top sectional view of the tubular heat exchanger of FIG. 3, along line 5—5 of FIG. 4.

Referring now to FIGS. 3–5, heat exchanger inlet 90 and outlet 92 are defined by upper and lower plates 94, 96, respectively, and the abutting edges of curved inner and outer walls 98, 100 which, when viewed from the top, provide a generally U-shaped airflow path from inlet 90 to outlet 92. Plates 94, 96 are provided with a plurality of round holes between the boundaries of walls 98, 100 through which are sealed the cylindrical outer surfaces of tubes 32, near the axial ends thereof. Thus, no intermingling of flue gases flowing through tubes 32 or the interior air flowing from inlet 90 to outlet 92 around the outside surfaces of the tubes occurs. Vertical plate 99 (FIG. 5) is provided on the rear of heat exchanger 34 between the leading and trailing edges of wall 98, preventing leakage of airflow from left hand U-shaped plenum 86 to right hand U-shaped plenum 88 around divider partition 78. Plates 94, 96, walls 98, 100 and tubes 36 are formed of a suitable corrosion resistant, heat conducting material. In the shown embodiments, heat exchanger 34 comprises a quantity of 34 plated steel tubes 32, each approximately five inches long, about one inch in diameter and spaced and arranged between walls 98 and 100 on flowing air streams and provide minimal pressure drop between inlet 90 and outlet 92. It is not intended, however, that the scope of the present invention be limited to the heat exchanger tube material, quantity, length and/or diameter indicated above, for airflow and heat transfer performance considerations as well as cost and package space factors will foreseeably lead to variations regarding these aspects of the invention. Therefore, the scope of the present invention should be understood to encompass foreseeable variations in material, tube quantity, length and/or diameter from that described above which achieve satisfactory heat transfer and fluid flow performance through both the flue gas and interior air sides of the heat exchanger.

An alternative embodiment to those shown may include an opening 101 in wall 100 outlined by the ghosted lines in FIG. 3. Opening 101 may be fitted with a damping door (not shown) to allow a quantity of heated interior air to be transferred from heat exchanger 34 into space 44 and out through grill 48 along a path shown by uppermost arrow D in FIG. 1A. Such an alternative embodiment may obviate the need for providing heated air to zone 1, wherein the fireplace is located, via a distribution duct as described below, thereby making available one of the three depicted distribution ducts (112, 114, 116) to heat a fourth zone.

Referring again to FIG. 2A, air heated by heat exchanger 34 is directed by right hand plenum 88 first downward then upwards, as indicated by arrows B, through vertical duct 102 in air collector box 60 and into vertical duct 104 in air conditioner housing 106. The air is then charged into collector space 110 of housing top cover 108 and through a plurality of outlets 109 in cover 108 and into individual distribution ducts 112, 114, 116 connected thereto. Ducts 112, 114, 116 are typically 6 inches in diameter and made of sheet steel as commonly used in heating and cooling applications. Dampers in each of ducts 112, 114, 116 allow the air to flow to the respective zones calling for heat via a thermostat 117 or other temperature monitoring device located in each zone.

Figure 11:
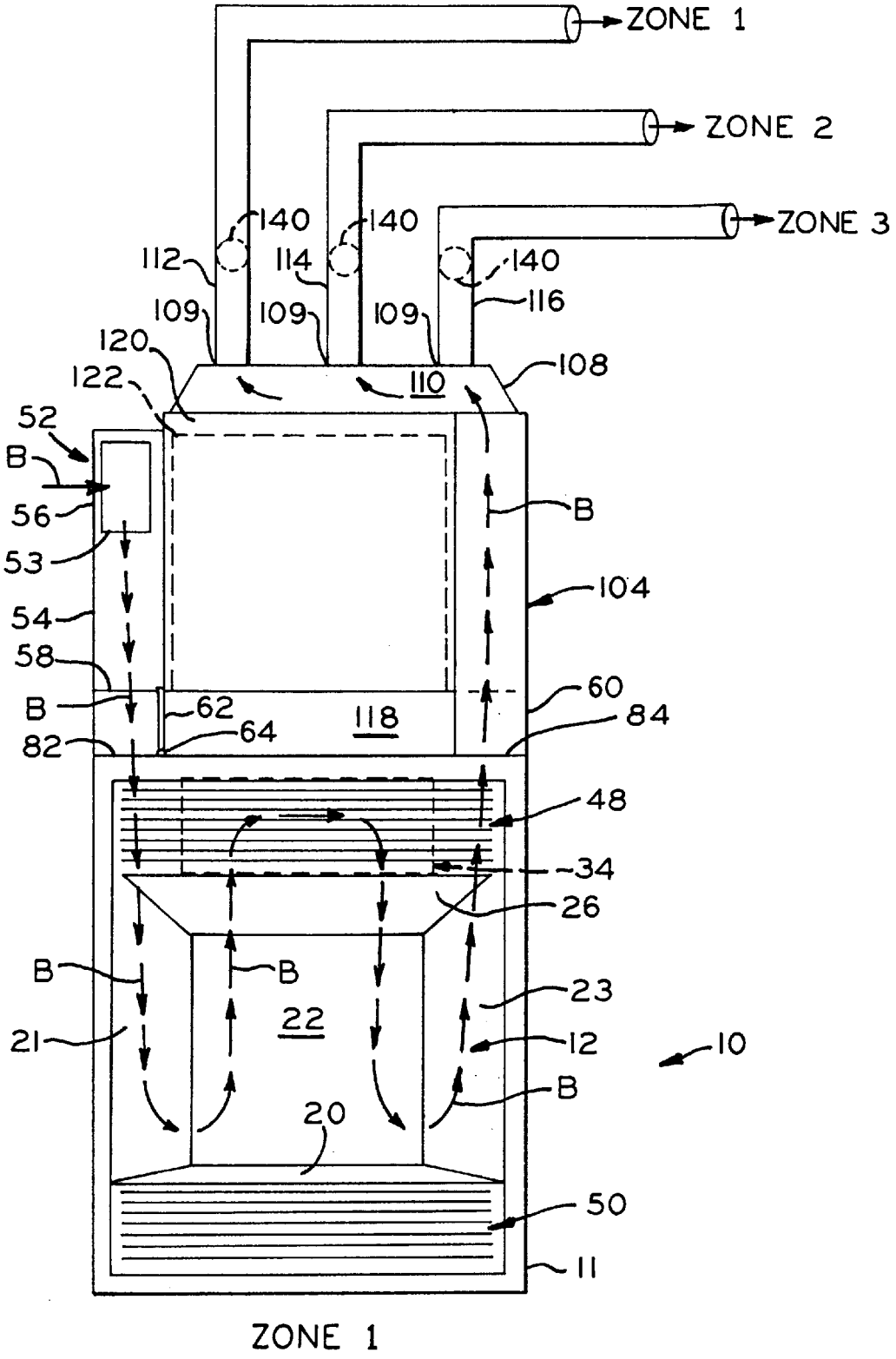
FIG. 11 is a schematic drawing, of a heating and cooling system according to the present invention, shown in the heating mode.

Referring now to FIG. 2B, it can be seen that air to be cooled or circulated is prevented from entering left hand plenum 86, which leads to heat exchanger 34, by heating/cooling diverter door 62. Rather, the airflow bypasses cabinet 11 and follows a path generally indicated by arrows C transversely through bypass plenum 118 in air collector box 60, from where it is directed upwards, through evaporator core 122 disposed in evaporator core housing 120, which is a part of air conditioner housing 106. Evaporator core 122 is shown having an A-shaped cross section, but it is contemplated that other evaporator core configurations may be used. Evaporator core 122 is incorporated into a typical air conditioning system (the remainder of which is not shown) further comprising a compressor, an outside heat exchanger or condenser, a flow restricting device and associated lines for conveying refrigerant. Air flowing through evaporator core 122, which air is cooled thereby if the air conditioning system is operating, is directed to collecting space 110 of top cover 108 and through a plurality of outlets 109 in cover 108 and into individual distribution ducts 112, 114, 116. In the shown embodiments, the dampers associated with ducts 112, 114 and 116 would each be in its open position while the fireplace is in the cooling/circulation mode, thus allowing airflow to each of the zones, the interior air temperature monitored solely by the heating/cooling thermostat 117*a* in zone 1. Those skilled in the art will, however, recognize that the individual zone thermostats 117*a*, 117*b*, 117*c* and the control circuit 13 may be adapted to regulate the flow of unheated air to the individual zones by controlling which dampers should be open and which should be closed, or by modulating the individual distribution duct dampers to positions between fully open and fully closed, in response to signals received by control circuit 13 from heating/cooling thermostats and/or fan controls located in each zone. A heating and cooling system according to the present invention is represented schematically in FIG. 11.

Figure 10:
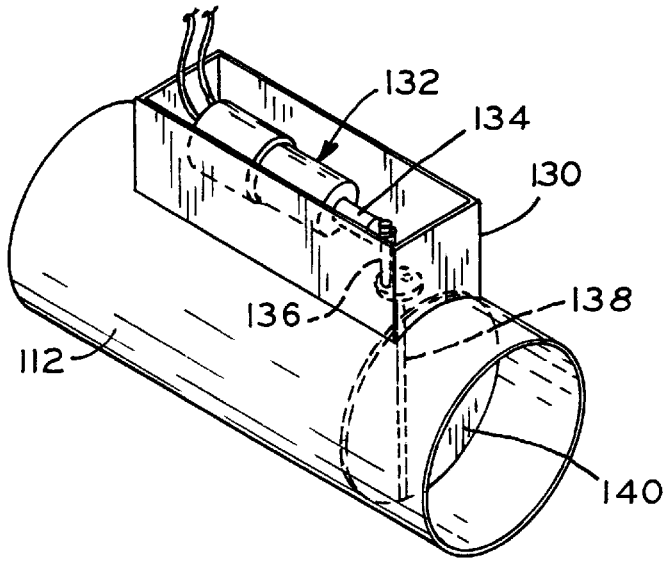
FIG. 10 is a perspective view of a distribution duct section, showing the damper and an example actuator.
Figure 9:
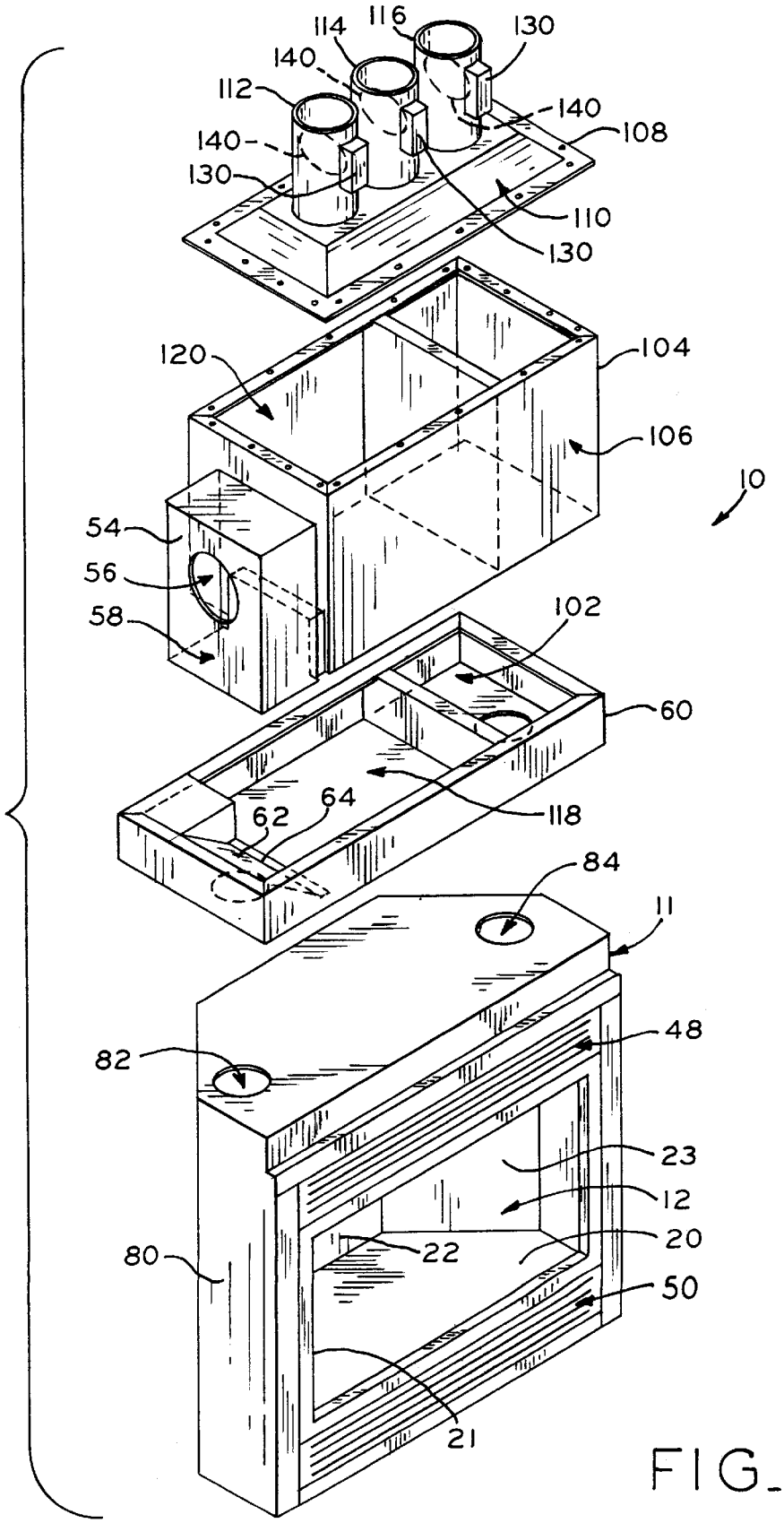
FIG. 9 is an exploded view of portions of the fireplace of FIG. 1A.

FIG. 10 shows the section of distribution duct 112 in which damper 140 is located, and is identical to corresponding sections of distribution ducts 114 and 116. In fireplace 10, three relays triggered by control circuit 13 control distribution duct damper actuators 132 associated with ducts 112, 114, 116. In the shown embodiments, actuators 132 are either of electric solenoid type or of electro-thermal type, the latter having a controlled working fluid inside a sealed chamber that is rapidly vaporized upon energizing the actuator, acting on a rolling diaphragm piston to drive axially traveling rod 134. Alternatively, stepper or servomotors may be used in lieu of actuators 132, with attendant revisions to the control circuit. The electric solenoid and electro-thermal type actuators better accommodate emergency heating mode operation in case of electrical power outage, however, as will be further discussed below. As seen in FIG. 10, actuator housing 130 is provided attached to the outside wall of duct 112. Actuator 132 is mounted in housing 130. The axially traveling rod 134 of actuator 132 is attached to crank pin 136, which is parallel to but offset from axis 138 about which damper door 140 is attached and pivots. Thus, as rod 134 moves axially, rotational movement is imparted to door 140 about axis 138. As noted above, with actuator 132 energized, rod 134 extends from the actuator, pushing on crank pin 136 such that door 140 assumes a closed position, blocking airflow through distribution duct 112. When voltage to actuator 132 is cut off, rod 134 retracts into the actuator, door 140 is brought into its fully opened position, allowing airflow to flow through the distribution duct. This arrangement will thus allow heated air to flow through the distribution ducts to the various zones in the event of an electrical power outage, the warm airflow through ducts 112, 114, 116 being substantially convective, of course, for fan assembly 52 would be rendered inoperable in such circumstance. Emergency heating mode will be further discussed below.

Figure 12:
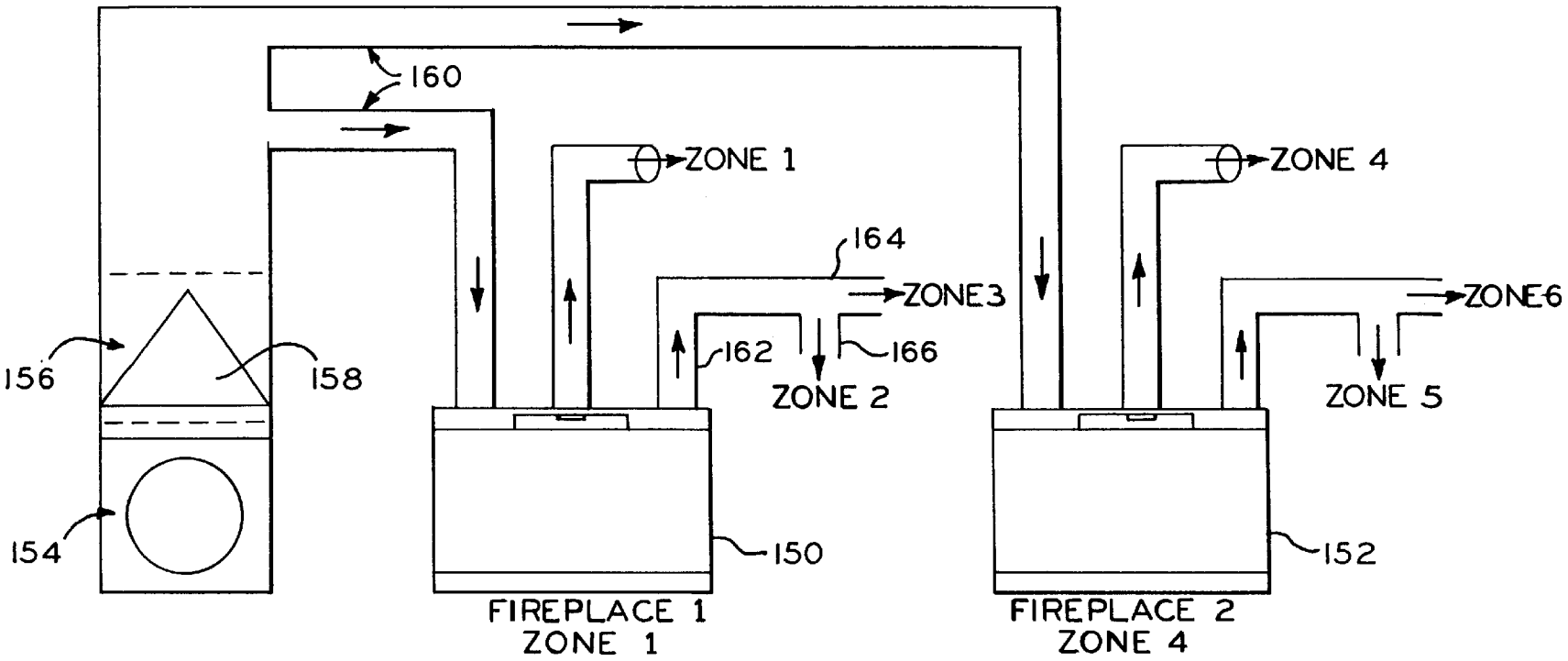
FIG. 12 is a schematic drawing of an alternative heating and cooling system comprising two fireplaces according to the present invention.
Figure 13A:
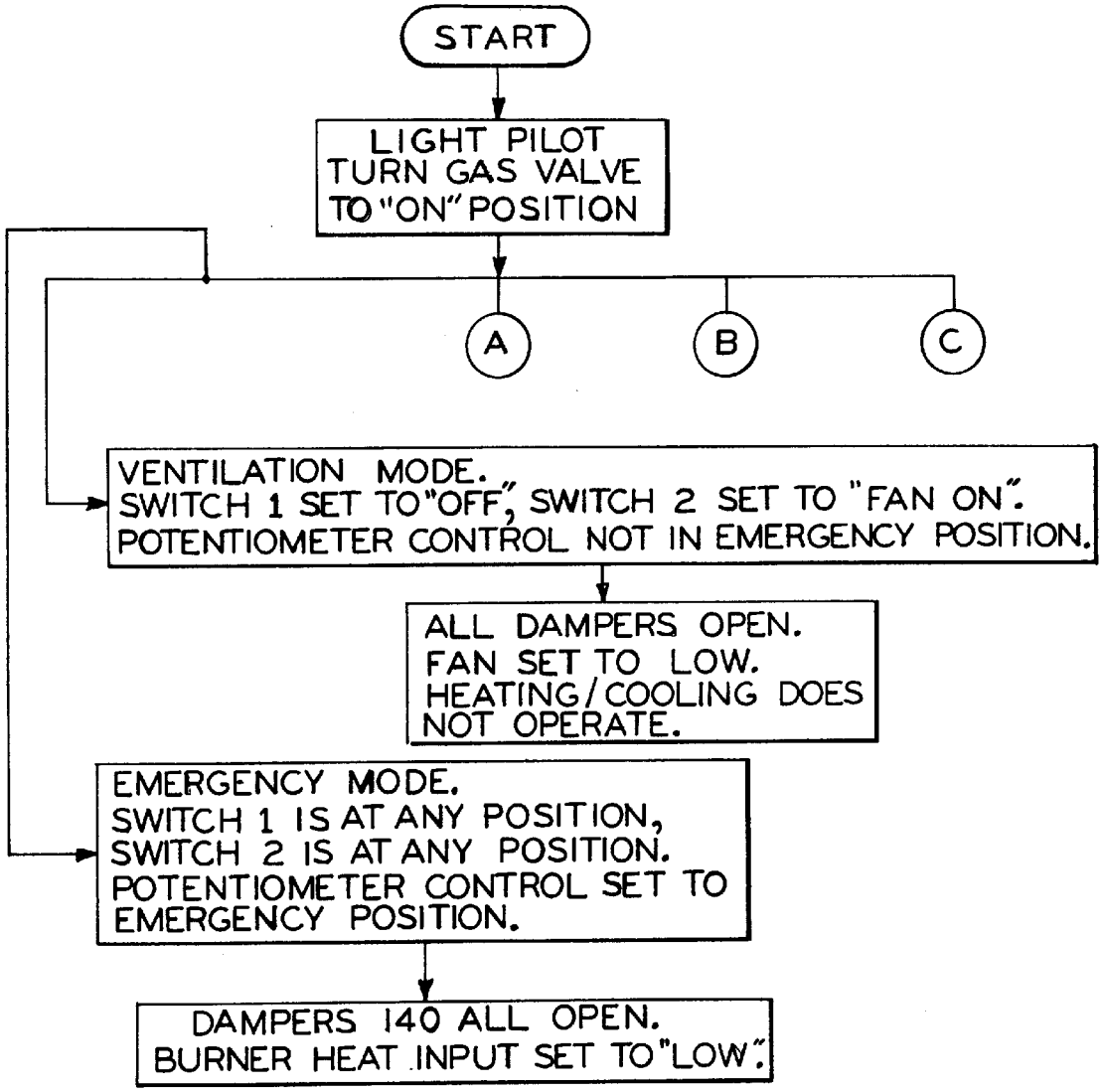
FIGS. 13A–F is a flowchart illustrating the operational logic of a fireplace according to the present invention.
Figure 13B:
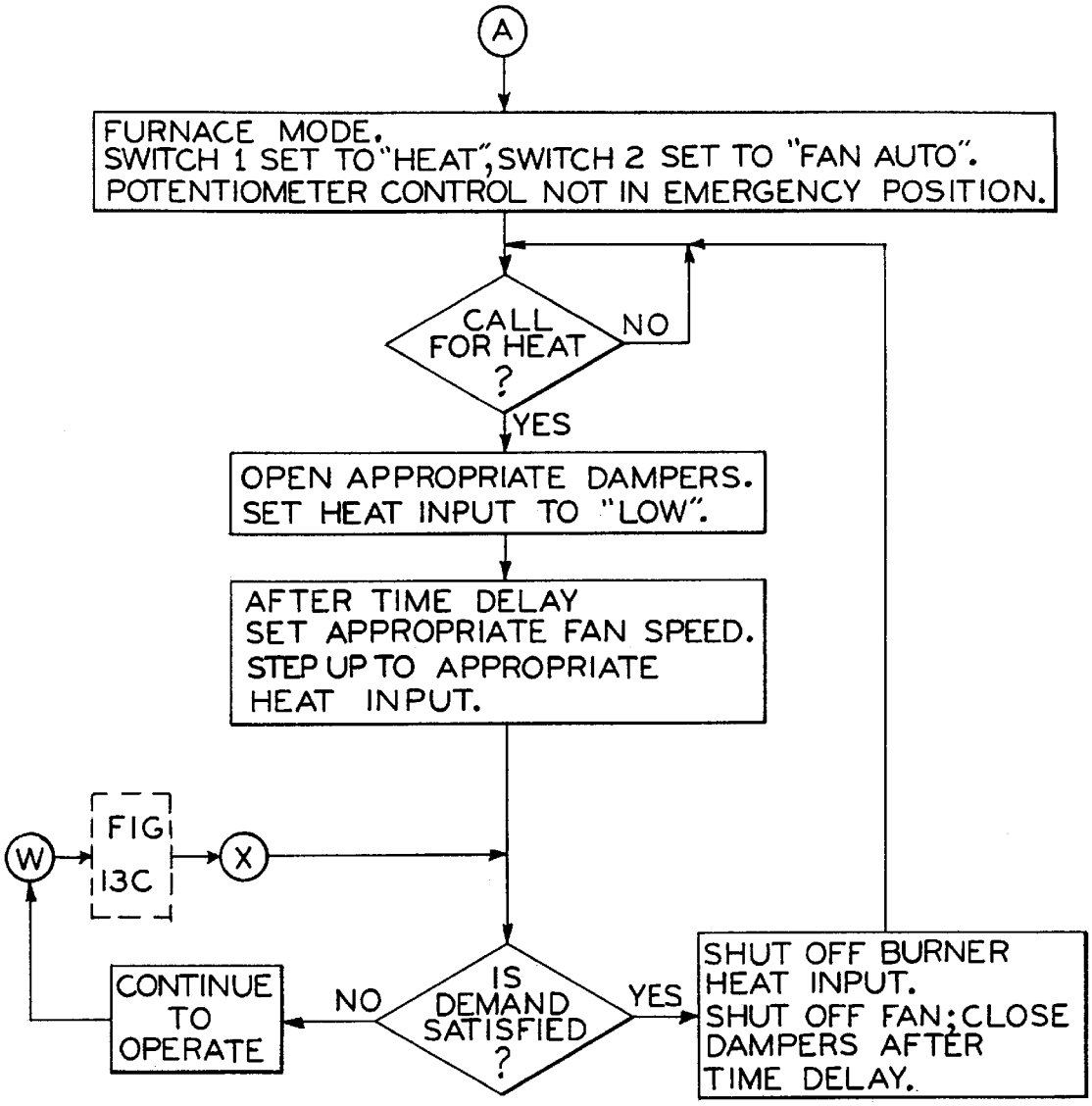
Figure 13C:
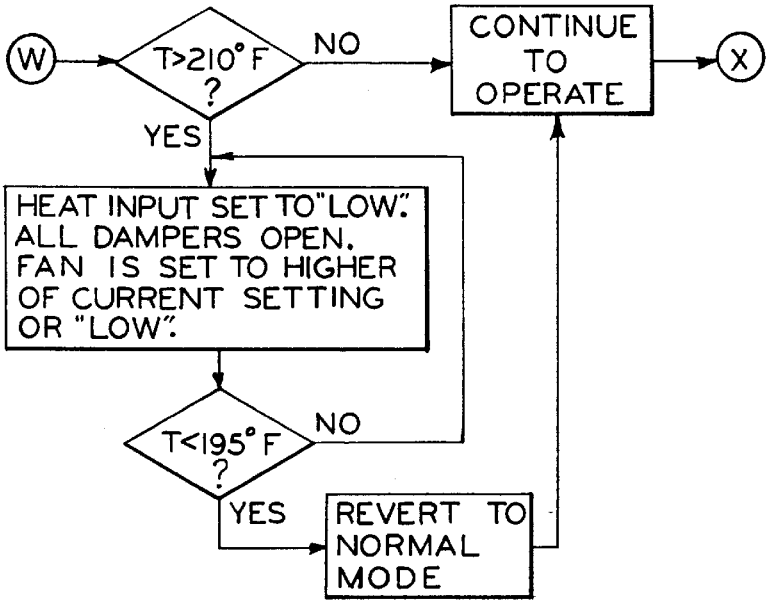
Figure 13D:
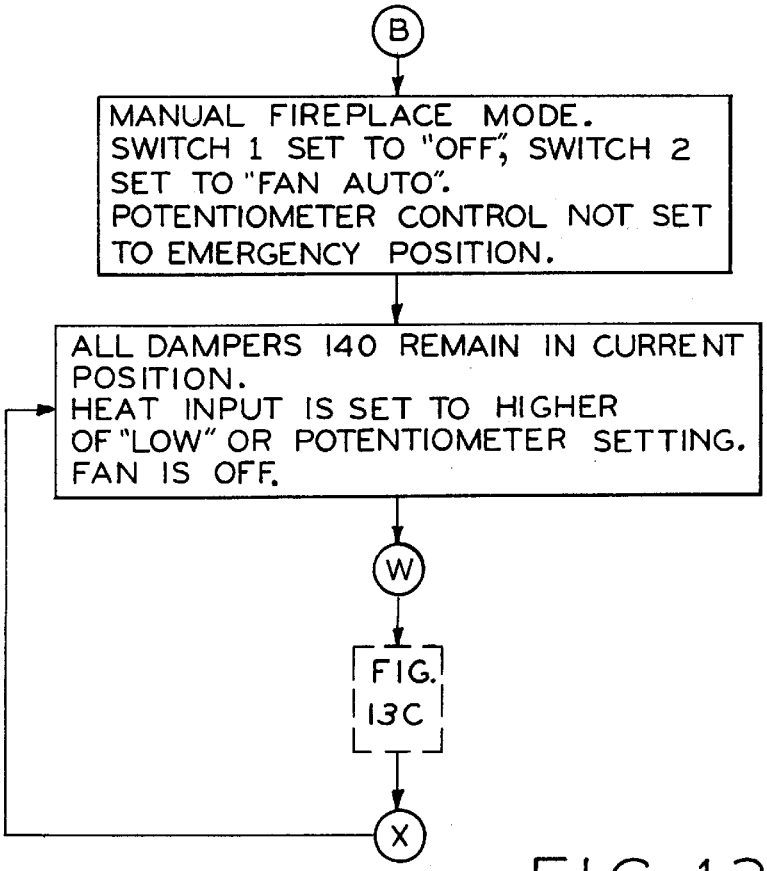
Figure 13E:
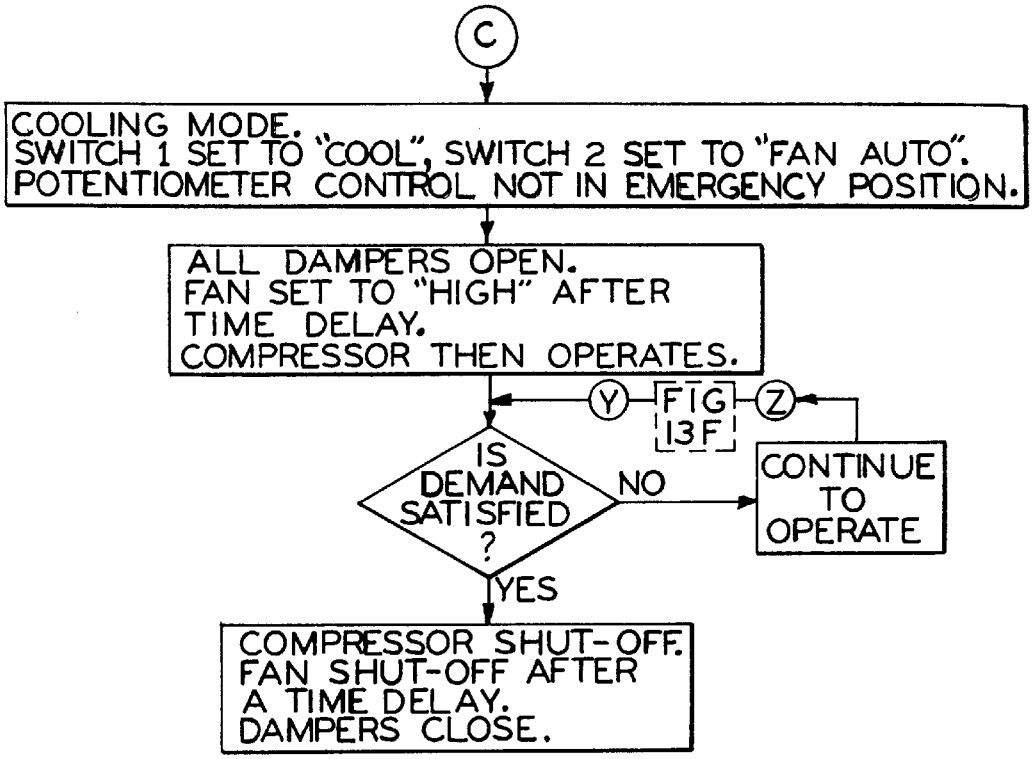
Figure 13F:
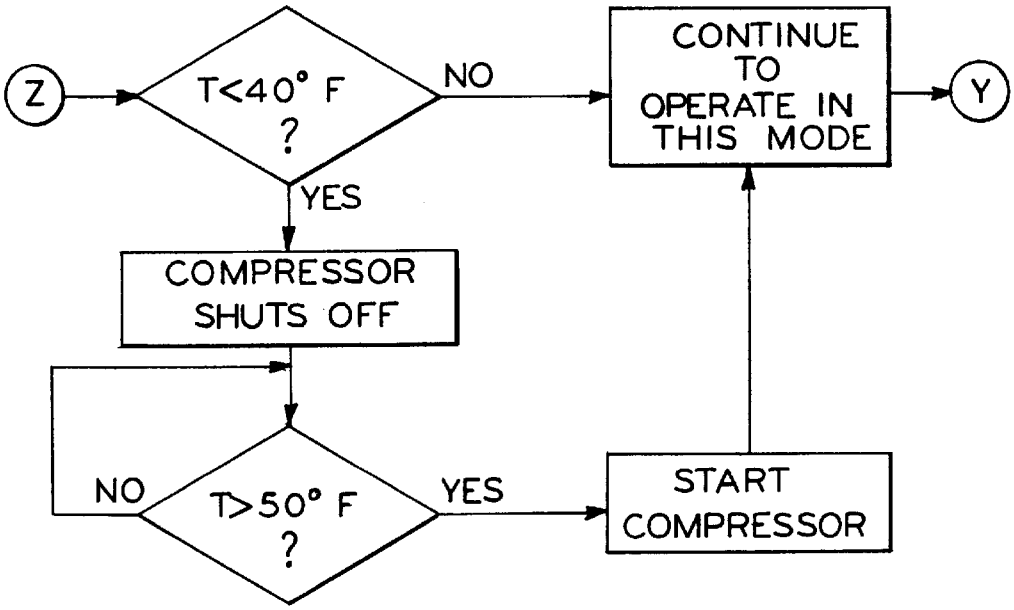

FIG. 12 shows various aspects of alternative embodiments according to the present invention. First, it is shown that a building may be served by more than one of the inventive fireplaces. While fireplace 10 may be adapted to service more than only three zones, one of which being the zone in which the fireplace is located, buildings having many heating and/or cooling zones may benefit by the installation of a second inventive fireplace. One of the two illustrated fireplaces, designated by reference numeral 150, is located in zone 1, the other, designated by reference numeral 152, is located in zone 4. Further, each or both of the fireplaces may be served by a fan assembly, such as blower 154, which is remotely located, with forced air delivered to the fireplace(s) via duct(s) 160. Moreover, an air conditioner housing, such as 156, may also be remotely located from the fireplace. In FIG. 12, blower 154 directs air through evaporator core 158 upstream of the fireplace(s). It is also envisioned that a single distribution duct 162 receiving airflow from fireplace 150 may be split downstream into two or more branch distribution ducts 164, 166 serving individual zones such as zone 2 and zone 3, each branch distribution duct having a damper and actuator as shown in FIG. 10.

A two-position switch turns the whole system on or off. When off, fan assembly 52 is inoperable; valve 15 is fully closed with its on/off contacts open and no flame is sustained at burner 14; heating/cooling diverter door 62 is in its heating position (FIG. 2A); and damper doors 140 of distribution ducts 112, 114, 116 are open. When on, fireplace 10 has the capability of operating with valve 15 modulating heat input between low, medium and high gas flow settings; with the fan speed modulated in steps between off, low, medium and high speed settings; with a two-position damper control which positions heating/cooling diverter door 62 at either its heating or cooling/circulation positions; and with damper position controls which alternate the positions of damper doors 140 in distribution ducts 112, 114, 116 between open and closed positions. Those skilled in the art will recognize that the control circuit, fan motor and zone duct damper door actuators may alternatively be adapted to provide "infinitely" variable fan operating speeds (between limits) and distribution duct dampers which modulate to positions between open and closed for finely regulating the airflow therethrough. Similarly, modulation of heat input levels may be "infinitely" variable between limits with appropriate revisions to the control circuit and valve. Further, the valve, fan motor and dampers may be controlled by an intelligent control system using fuzzy logic/neural network and having the capability to monitor the inventive fireplace's performance, learn from past history, and make suitable adjustments as to how the operation is carried out. For operating fireplace 10, the zone 1 heating/cooling thermostat 117*a* may be comprised of simple Heat-Off-Cool and Fan On-Fan Auto switches (where the fan runs continuously in low speed in the "Fan On" position) and a separate manual potentiometer control knob for setting the desired manual temperature or selecting emergency mode, or may be of a programmable type; in remote zones, only simple heat thermostats are necessary. Alternatively, programmable heat thermostats or heating and cooling thermostats may be used in remote zones. Below and in the flowchart of FIGS. 13A–F, the above-mentioned Heat-Off-Cool switch is referred to as "Switch 1", and the Fan On-Fan Auto switch is referred to as "Switch 2".

Fireplace 10 has five operating modes: furnace mode (heating); manual fireplace mode; emergency heating mode; cooling mode; and ventilation/circulating air mode, the operation of the fireplace in each of these modes will now be described. In addition to the following textual description, reference may be made to the flowchart of FIGS. 13A–F, which illustrates the operational logic of the inventive fireplace's control circuit 13.

In furnace mode, Switch 1 is set to "Heat" and Switch 2 is set to "Fan Auto" and the potentiometer control is not in its emergency position. In this mode, when any of the zones calls for heat through the activation of respective its thermostat 117*a*, 117*b*, 117*c*, fireplace 10 starts at its lowest heat input, at the low gas flow setting of valve 15, until a predetermined time, for example, one minute, programmed into the control circuit has expired, by which time a flow (draft) through the combustion chamber will have been established along the path indicated by arrows A (FIG. 1A). Once this time has been reached, a control circuit switch, which is normally open, closes and completes a circuit to the motor of fan assembly 52, allowing it to be operated.

In this mode, the fan speed is adjusted to the speed corresponding to the number of zones currently calling for heat or, if no zones are calling for heat, is off; the heat input is set to the higher of either the manual mode potentiometer setting or the heating mode setting at any of the zone thermostats, thus the fireplace may also serve an aesthetic purpose in furnace mode. Simultaneous with the firing of the fireplace at its lowest setting, damper(s) 140 open selected distribution ducts 112, 114, 116 to the zone(s) calling for heat. Where electric solenoid or electro-thermal actuators 132 are used to position damper 140, control circuit 13 cuts power to a relay associated with damper actuator 132 for the zone(s) calling for heat, de-energizing actuator 132 and causing damper 140 to open. In this mode dampers 140 in distribution ducts 112, 114, 116 are open only to zones currently calling for heat or, if no zones are calling for heat, are closed. If, while in furnace mode, the heat input demand of any of the zones, as recognized by its thermostat 117, exceeds that of the potentiometer heat level setting, control circuit 13 will switch over to furnace mode until the call for heat in each zone is satisfied. While in furnace mode, the fan will go to its low speed (one zone calling for heat), medium speed (two zones calling for heat) or high speed (three zones calling for heat) setting and the low heat input and remote damper settings are appropriately overridden until the call for heat in the calling zone(s) is satisfied. Once the demand for heat is satisfied, the heat input setting reverts to its original setting, dampers 140 close and the fan is turned off. A temperature limit switch located in collector space 110 provides a safety factor to prevent overheating of the fireplace, as described below. To accommodate heating to all zones in case of an electrical power outage, electric solenoid or electro-thermal actuators 132 are arranged to position dampers 140 in their open position when no power is provided to the actuator and to close the dampers when power is applied thereto. Those skilled in the art will recognize that electric servo or stepper motors may be used as actuators 132 for damper 140 position control with appropriate revisions to the control circuit, allowing individual dampers 140 to be variably positioned to finely modulate the airflow to each zone.

As indicated above, when in furnace mode, fan assembly 52 is disabled until a time programmed in the control circuit has elapsed which will allow convective flow (draft) through the combustion chamber to become established. Once this time has elapsed, fan assembly 52 starts at a low speed setting. Gas valve 15 may be then modulated, as described below, to higher heat input levels, followed by the appropriate, programmed fan speed. In normal furnace mode operation, the heat input level is set by control circuit 13 adjusting modulating gas valve 15 according to the number of zones calling for heat. For example, with a three zone system, gas valve 15 remains closed when no zones call for heat; the valve opens to its lowest heat input level when one zone calls for heat; the valve opens to its medium heat input level when two zones call for heat; and the valve opens to its maximum heat input level when three zones call for heat. Similarly, the fan speed is adjusted by the control circuit to correspond with the number of zones calling for heat. Thus, when one zone calls for heat, the fan speed and the gas valve are set to low; when two zones call for heat, the fan speed and the gas valve are set to medium; and when three zones call for heat, the fan speed and the gas valve are set to high. The range of modulated inputs from valve 15 varies from a gas pressure of 1.8 inches of water at the minimum setting to 3.5 inches of water at the maximum setting, corresponding to a heat input range of about 20,000 to 44,000 Btu/hour for natural gas. To provide satisfactory heating performance, the three operating speeds of fan assembly 52 should be selected such that the fireplace and distribution ducts deliver approximately 100 to 150 cubic feet per minute (CFM) of heated interior air to each zone calling for heat.

Once the demand for heat in each calling zone is met, damper door 140 in the distribution duct leading to the satisfied zone is closed and the heat input and fan speed are reduced accordingly. When only one zone calls for heat, or when only one zone of a plurality of zones calling for heat remains to be satisfied, upon meeting the heat demand for that single zone the heat input is shut off, after which the fan runs on for a short time (e.g., 1 minute) before shutting off, and damper door 140 to that single zone then closes. A temperature limit switch located in collector space 110 provides a safety factor to prevent overheating of the fireplace, as described below.

Those skilled in the art will recognize that alternative embodiments of the present invention using an intelligent control circuit may, based on information that it has learned about each zone it is heating, adjust the fan speed and heat input to maximize the heating rate until that zone is nearly at its set point. The intelligent control circuit would then progressively cut back on the heat input and fan speed as the set point is reached to prevent overheating. In all embodiments, however, when in furnace mode and the heat demand is met, the gas valve closes to provide no heat input, after which the fan switches off and the distribution duct damper(s) close.

In the manual fireplace mode, Switch 1 is set to "Off", Switch 2 is set to "Fan Auto" and the potentiometer control not set to its emergency position. In this mode the fan speed is first automatically set to "off" as the default setting. The heat input is controlled via the wall mounted potentiometer in zone 1 which adjusts the amount of gas flow through valve 15, varying the height of the flames viewed through front panel 24. The heat input default on startup of fireplace mode is the low heat input setting, from which it is appropriately adjusted to a higher potentiometer setting. Dampers 140 in ducts 112, 114, 116 remain in their positions assumed prior to the selection of manual fireplace mode. Diverter door 62 is positioned to open a passage from the interior air inlet to the cabinet plenums. A temperature limit switch located in collector space 110 provides a safety factor to prevent overheating of the fireplace in this mode, adjusting the fan speed from off to low and maintaining the heat input at low. Overheating prevention is discussed below.

Alternatively, the control circuit may be modified to allow the user to select which zone(s) should be used for dumping heat, the damper(s) to only the selected zone(s) would then be open while in fireplace mode, and all others would remain closed. For example, zone 1 may be selected for dumping heat while in fireplace mode and in this case only the damper of zone duct 112 will be opened to provide heating to zone 1. In this alternative embodiment, low airflow bypass holes (not shown) are provided in the damper doors 140 of distribution ducts 114, 116 supplying the remote zones, and thus a modicum of convective heat will still be supplied thereto.

In both the furnace and fireplace modes, however, should the fireplace become overheated, exceeding 210° F. (98.9° C.), for example, or another preselected temperature in collector space 110 as sensed by a temperature switch (not shown) located therein, and none of the zones is calling for heat, then the heat input level is set to low, all dampers open, and the fan is set to the higher of its current setting or low. This operation continues until the temperature in collector space 110 drops below 195° F. (90.6° C.), for example, or another preselected temperature, at which point the fireplace reverts to its normal, manual fireplace or furnace mode of operation.

An optional feature in an alternative embodiment of the inventive fireplace includes a "random setting" in fireplace mode to continually adjust the flame height to varying levels, creating a more realistic appearance.

In either the furnace or fireplace modes, a switch on the zone 1 potentiometer or, alternatively, an automatic switch on the control circuit, selects between normal and emergency heat modes, regardless of the positions of Switches 1 and 2. Emergency mode can be selected whether or not power is supplied to the control circuit. If the pilot is not already lit when switching to the "emergency" position, the Piezoelectric ignitor must be used to establish the pilot. In the emergency mode, the fireplace is only allowed to operate at low heat input rate to prevent fireplace overheating, for the fan will be without power. Because no electrical power is being supplied to the actuators of any of doors, heating/cooling diverter door 62 assumes the position shown in FIG. 2A, providing a convective passage for interior air to flow from the inlet through (nonrotating) fan 53, through the cabinet plenum and heat exchanger 34, and out through distribution ducts 112, 114, 116, the dampers 140 of which are open. The heating of interior air within heat exchanger 34 by the low level heat input at the combustion chamber establishes a mild convective airflow of interior air through the fireplace and distribution ducts, providing some amount of heating to the various zones. Zone 1 additionally receives radiant heating from the combustion chamber through glass panel 24 and a small amount of convective heating out of grill 48 from air circulating through spaces 44, 46, the air in space 44 absorbing heat from the outside surfaces of heat exchanger 34 and plenum 36, and from the upper surface of combustion chamber top 18. When electrical power has been restored, the normal/emergency automatically switches over to normal, manual fireplace mode, in which the control logic previously discussed takes precedence. Alternatively, a manual switch may be used to switch from emergency to normal operation after restoration of power.

In cooling mode Switch 1 is set to "Cool", Switch 2 is set to "Fan Auto", and the potentiometer is not set to its emergency position. In this mode the fan speed and distribution duct damper positions are used to controlling the level of cooling to the zones. The heating/cooling thermostat 117*a* in zone 1 would issue the call for cooling to the control circuit, which closes diverter door 62 against airflow through cabinet 11 and directs all interior airflow in the fireplace laterally through bypass plenum 118 in air collector box 60 and upwards through evaporator core 122. The distribution duct dampers are all directed to their open positions, the fan starts on high speed and the air conditioning system compressor starts after a preprogrammed time period of, for example, one minute. In cooling mode, it is anticipated that approximately 300 CFM per ton of cooling will be required. Thus, for an air conditioning system having a 1.5 ton capacity, for example, on the high fan speed setting approximately 450 to 500 CFM flows through evaporator core 122 and is distributed amongst all zones through ducts 112, 114, 116. When the desired set point is reached the compressor is turned off, followed, after a short delay of, for example, one minute, by the fan turning off and the dampers closing. If, during cooling, the temperature switch (not shown) in collector space 110 drops below 40° F. (4.4° C.), for example, or another preselected temperature, then the compressor shuts off and the fan remains on high speed until the temperature switch in the collector space reaches 50° F. (10° C.), for example, or another preselected temperature, at which point the compressor is restarted. Those skilled in the art will recognize that the control circuit and/or the damper actuators may be modified to provide cooling air to each zone in response to a demand sensed by heating/cooling thermostats located in each zone.

In the ventilation/air circulation mode there would be no heating or cooling provided. This mode is selected by setting the zone 1 thermostat 117*a* Switch 1 to "Off" and Switch 2 to "Fan On", with the potentiometer not set to its emergency position. This mode inhibits operation of the fireplace, manually or as a furnace, and of the cooling system. All distribution duct dampers 140 open and the fan speed is automatically set to "low" to provide some in-house air recirculation along the same airflow path used for cooling.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A fireplace comprising: a cabinet, a combustion chamber within said cabinet, said combustion chamber defined in part by a plurality of walls, a burner and decorative logs disposed in said combustion chamber, said cabinet having a transparent panel through which said decorative logs are viewed, a first plenum connected to an interior air inlet and a second plenum connected to interior air outlet means, said first and second plenums located within said cabinet and defined in part by said combustion chamber walls, a heat exchanger element in thermal connection with hot gases generated in said combustion chamber and connected serially between said first and second plenums, and a plurality of distribution ducts connected to said outlet means and leading to a plurality of respective individual zones.

2. The fireplace of claim 1, further comprising an evaporator core in fluid communication with said outlet means and an interior air diverter mechanism disposed between said interior air inlet and said evaporator core, said diverter mechanism selectively fluidly connecting said interior air inlet with said evaporator core, bypassing said heat exchanger element.

3. The fireplace of claim 2, further comprising airflow modulation mechanisms connected to a thermostat in a first zone and said plurality of distribution ducts, whereby the airflow to each individual zone is modulated in response to a demand sensed by a thermostat in said first zone.

4. The fireplace of claim 1, further comprising at least one fan in fluid communication with said interior air inlet.

5. The fireplace of claim 4, wherein said at least one fan is disposed proximate to said interior air inlet.

6. The fireplace of claim 4, wherein said at least one fan is disposed remotely from said interior air inlet and connected thereto with a duct.

7. The fireplace of claim 4, wherein said fan is a multi-speed fan.

8. The fireplace of claim 7, wherein said multi-speed fan is connected to thermostats in each said zone, whereby the fan speed is selected in response to demands sensed by said thermostats in said zones.

9. The fireplace of claim 1, further comprising airflow modulation mechanisms connected to thermostats in each zone and said plurality of distribution ducts, whereby the airflow to each individual zone is modulated in response to a demand sensed by a thermostat in that zone.

10. The fireplace of claim 1, further comprising a fuel flow modulator mechanism interposed between a source of fuel and said burner.

11. The fireplace of claim 10, wherein said fuel flow modulator mechanism is a variable flow rate valve, said valve connected to thermostats in each said zone, whereby the flow of fuel to said burner is modulated in response to demands sensed by said thermostats in said zones.

12. A fireplace comprising: a cabinet, a combustion chamber within said cabinet, said combustion chamber defined in part by a plurality of walls, a burner and decorative logs disposed in said combustion chamber, said cabinet having a transparent panel through which said decorative logs are viewed, a first plenum fluidly connected to an interior air inlet and a second plenum fluidly connected to interior air outlet means, said first and second plenums located within said cabinet and defined in part by said combustion chamber walls, a heat exchanger element in thermal communication with hot gases generated in said combustion chamber, said first and second plenums and said heat exchanger element connected in series and defining a generally W-shaped interior air flow path through said cabinet.

13. The fireplace of claim 12, further comprising an evaporator core in fluid communication with said interior air outlet means and an interior air diverter mechanism disposed between said interior air inlet and said evaporator core, said air diverter mechanism selectively fluidly connecting said evaporator core with said interior air inlet, whereby said interior air flow path bypasses said heat exchanger element.

14. The fireplace of claim 12, wherein said first and second plenums are defined in part by a plurality of baffles disposed in said cabinet.

15. The fireplace of claim 14, wherein said first and second plenums are separated in part by a vertically extending dividing partition within said cabinet.

16. The fireplace of claim 12, wherein each of said first and second plenums defines a generally U-shaped airflow path, whereby interior air flows first downwardly and then upwardly through said each of said first and second plenums, said heat exchanger element positioned between said first and second plenums.

17. The fireplace of claim 12, wherein said heat exchanger element is positioned between said first and second plenums and forms part of a top wall of said combustion chamber.

18. The fireplace of claim 12, further comprising an exhaust flue, said heat exchanger element further comprising a plurality of flow conduits serially connected between said combustion chamber and said exhaust flue.

19. The fireplace of claim 18, wherein said heat exchanger element is positioned between said first and second plenums and forms part of a top wall of said combustion chamber.

20. The fireplace of claim 18, wherein said plurality of flow conduits are arranged along flowing air streams of the interior airflow path through said heat exchanger element.

21. The fireplace of claim 12, wherein said first and second plenums are thermally connected with said combustion chamber through walls partly defining said plenums and said combustion chamber.

22. A fireplace comprising: a cabinet, a combustion chamber within said cabinet, a burner and decorative logs disposed in said combustion chamber, said cabinet having a transparent panel through which said decorative logs are viewed, a first plenum in fluid communication with an interior air inlet and a second plenum, said first and second plenums in series connection with a heat exchanger in thermal connection with hot gases generated in said combustion chamber, a bypass plenum adjacent said cabinet and having a diverter mechanism disposed therein, said diverter mechanism selectively connecting said interior air inlet with one of an evaporator core and said first cabinet plenum, said evaporator core in fluid communication with said bypass plenum and outlet means.

23. The fireplace of claim 22, wherein said diverter mechanism comprises a hinged door swingable between a first position and a second position, whereby said first door position fluidly connects said interior air inlet and said cabinet ducts and said second door position fluidly connects said interior air inlet and said evaporator core.

24. The fireplace of claim 22, wherein said bypass plenum is contained within an air collector box, said box disposed between said cabinet and an air conditioner housing in which said evaporator core is disposed.

25. The fireplace of claim 24, wherein said box and said air conditioner housing further contain conduits fluidly connecting said second plenum and said outlet means.

26. The fireplace of claim 24, further comprising a fan housing having an inlet, an outlet and a fan disposed therein, said fan housing disposed adjacent said air collector box, said fan housing outlet fluidly connected to said bypass plenum.

27. A system for heating a plurality of zones in a building, said system comprising:

a fireplace comprising a cabinet, a combustion chamber located in said cabinet, a burner and decorative logs disposed in said combustion chamber, said cabinet having a transparent panel through which said logs are viewed, a first plenum in fluid communication with an interior air inlet, a second plenum in fluid communication with a plurality of interior air outlets, and a heat exchanger in series connection with said first and second plenums, said heat exchanger in thermal communication with hot gases generated in said combustion chamber;

a system of distribution ducts in fluid communication with said interior air outlets and a plurality of individual zones, each said outlet connected to a respective, individual zone, whereby interior air exiting said fireplace through at least one of said interior air outlets is conveyed to at least one of said zones; and an airflow modulation mechanism connected to a thermostat in at least one said zone and a said interior air outlet in fluid communication with said at least one zone, whereby airflow to said at least one zone is modulated in response to a demand sensed by said thermostat, said airflow modulation mechanism comprising a damper, whereby the amount of airflow to that said at least one zone is regulated.

28. The system of claim 27, further comprising airflow modulation mechanisms connected to thermostats in each zone and each said interior air outlet, whereby airflow to each zone is modulated in response to a demand sensed by a thermostat in at least one of said zones.

29. The system of claim 27, wherein said cabinet further comprises a plurality of baffles, said baffles partly defining said cabinet plenum, said cabinet plenum defining a generally W-shaped interior air flow path through said cabinet.

30. The system of claim 27, further comprising an evaporator core and an interior air diverter mechanism disposed between said air inlet and said evaporator core, said air diverter mechanism selectively fluidly connecting said evaporator core with said interior air inlet, whereby said interior air flow path bypasses said heat exchanger.

31. A fireplace having a cabinet, a combustion chamber within said cabinet, said combustion chamber defined in part by a plurality of walls, decorative logs and a burner disposed in said combustion chamber, said cabinet including a transparent panel through which said logs are viewed, said cabinet having a first plenum and a second plenum, said first and second plenums located within said cabinet and defined in part by said combustion chamber walls, and a heat exchanger element in thermal communication with said combustion chamber and interposed between said first and second plenums, said heat exchanger element having an air inlet in fluid communication with an air outlet of said first plenum and an air outlet in fluid communication with an air inlet of said second plenum, said heat exchanger element comprising walls defining a generally U-shaped interior air flow path, said generally U-shaped interior air flow path extending between an air inlet and an air outlet of said heat exchanger element, and a plurality of conduits extending through said interior air flow path and through which conduits combustion gases flow.

32. The fireplace of claim 31, wherein said plurality of conduits are arranged on flowing air streams between said walls.

33. The fireplace of claim 31, wherein said heat exchanger element partly defines a top wall of said combustion chamber.

34. The fireplace of claim 31, wherein said heat exchanger conduits comprise tubes, said interior airflow path flowing around the outside surfaces of said tubes.

35. The fireplace of claim 31, wherein said heat exchanger walls include generally horizontal top and bottom walls through which said conduits extend and generally vertical inner and outer walls.

36. The fireplace of claim 35, wherein said generally vertical outer wall has an aperture through which interior air exits from said heat exchanger element.

* * * * *